US011746450B2

(12) United States Patent
Cavanaugh et al.

(10) Patent No.: US 11,746,450 B2
(45) Date of Patent: Sep. 5, 2023

(54) INTERLOCK-KNIT FABRIC

(71) Applicant: See Rose Go, Inc., Sunnyside, NY (US)

(72) Inventors: Erin Cavanaugh, Nashville, TN (US); Xiao Yi Zhou, Sunnyside, NY (US)

(73) Assignee: See Rose Go, Inc., Sunnyside, NY (US)

( * ) Notice: Subject to any disclaimer, the term of this patent is extended or adjusted under 35 U.S.C. 154(b) by 461 days.

(21) Appl. No.: 16/552,440

(22) Filed: Aug. 27, 2019

(65) Prior Publication Data

US 2020/0071861 A1 Mar. 5, 2020

Related U.S. Application Data

(60) Provisional application No. 62/723,878, filed on Aug. 28, 2018.

(51) Int. Cl.
*D04B 1/12* (2006.01)
*D04B 1/24* (2006.01)

(52) U.S. Cl.
CPC ..... *D04B 1/12* (2013.01); *D04B 1/24* (2013.01); *D10B 2501/00* (2013.01)

(58) Field of Classification Search
CPC . D04B 1/12; D04B 1/24; D04B 1/123; D04B 7/16; D04B 7/18
See application file for complete search history.

(56) References Cited

U.S. PATENT DOCUMENTS 3,971,234 A * 7/1976 Taylor ..... D04B 1/18 66/200
4,785,558 A * 11/1988 Shiomura ..... A43B 1/04 36/114
5,651,847 A * 7/1997 Loeffler ..... D04B 1/16 66/19
6,105,401 A * 8/2000 Chadeyron ..... D04B 1/22 66/195
7,867,056 B2 * 1/2011 Scheininger ..... A41C 3/12 450/74
7,867,057 B2 * 1/2011 Scheininger ..... A41C 3/12 450/74
9,856,587 B2 * 1/2018 Akita ..... D04B 1/18
2004/0237599 A1 * 12/2004 Kondou ..... D04B 15/50 66/202
2010/0050699 A1 * 3/2010 Kolmes ..... A41B 9/00 66/174
2014/0238084 A1 * 8/2014 Yoshida ..... D04B 21/207 66/174
2016/0040328 A1 * 2/2016 Yoshida ..... D04B 1/18 66/202
2016/0265146 A1 * 9/2016 Liao ..... D04B 15/80
2019/0309452 A1 * 10/2019 Liao ..... D04B 1/18

FOREIGN PATENT DOCUMENTS

WO WO-2018081057 A1 * 5/2018 ..... D04B 1/123

* cited by examiner

*Primary Examiner* — Danny Worrell
(74) *Attorney, Agent, or Firm* — Covington & Burling LLP; Jennifer L. Robbins; Melody Wu

(57) ABSTRACT

Novel and innovative fabrics in which at least two types of yarn are knit together in an interlock jersey knit, as well as methods of manufacturing these interlock jersey knit fabrics and garments (such as dresses and T-shirts) made from such interlock jersey knit fabrics.

33 Claims, 3 Drawing Sheets

INTERLOCK-KNIT FABRIC

CROSS-REFERENCE TO RELATED APPLICATION

This application claims the benefit under 35 U.S.C. § 119(e) of U.S. Provisional Patent Application No. 62/723,878, filed Aug. 28, 2018, which is hereby incorporated by reference in its entirety herein.

TECHNICAL FIELD

The present invention generally relates to novel fabrics in which at least two different types of yarn are knit together in an interlock jersey knit, as well as methods for manufacturing such fabrics.

BACKGROUND OF THE INVENTION

Existing fabrics for manufacturing clothing include fabric made from cooling, wicking technical polyester yarns (such as Invista's COOLMAX® fibers), as well as fabric made from cotton fibers. Each of these types of fabrics provides different performance benefits.

Fabrics made from technical polyester fibers, for example, provide several performance benefits. Such fabrics show highly consistent performance over time (e.g., with good fabric stability) and are easily cared for (e.g., with excellent wash fast and colorfast performance). Such fabrics also feature good (and permanent) moisture management and wicking performance, and exhibit good air permeability.

Fabrics made from cotton fibers provide different benefits, while still exhibiting good fabric stability and being easy-care. For example, these cotton fabrics provide comfort and durability benefits. Such cotton fabrics have a soft, comfortable, and natural touch and feel, a relatively heavier fabric weight, and provide a 4-way stretch to a wearer.

There remains a need, however, for a fabric that provides both the performance benefits of a technical polyester fabric and the comfort and durability benefits of a cotton fabric for use in clothing and other applications.

SUMMARY OF THE INVENTION

We have invented a fabric in which a first type of yarn is knit with a second type of yarn using an interlock jersey knit, resulting in a fabric that provides the benefits of both the first yarn and the second yarn—for example, the performance benefits of a technical polyester yarn and the comfort and durability benefits of a cotton yarn—as well as methods of manufacturing such interlock-knit fabrics.

The present invention is directed, in certain embodiments, to fabrics comprising a first yarn and a second yarn, wherein the first yarn and second yarn are knit together in an interlock jersey knit.

In certain embodiments, a fabric comprises a first yarn and a second yarn, the first yarn comprising at least one of nylon, rayon, spandex/elastane, and polyester fibers. In certain further embodiments, the first yarn comprises polyester fibers that are technical polyester fibers. In certain further embodiments, the first yarn comprises technical polyester fibers that are COOLMAX® fibers.

In certain embodiments, a fabric comprises a first yarn and a second yarn, the first yarn comprising technical polyester fibers, and the second yarn comprising linen fibers. In certain further embodiments, the technical polyester fibers are COOLMAX® fibers. In certain further embodiments, the fabric comprises from 35% to 40% of the first yarn, and from 60% to 65% of the second yarn.

In certain embodiments, a fabric comprises a blend of a first type of fiber, a second type of fiber, and a third type of fiber. In certain further embodiments, the first type of fiber is rayon fiber, the second type of fiber is a technical polyester fiber, and the third type of fiber is spandex/elastane fiber. In certain further embodiments, the fabric comprises from 50% to 60% of the first type of fiber, from 35% to 45% of the second type of fiber, and 5% of the third type of fiber.

In certain embodiments, a fabric comprises a first yarn and a second yarn, and the second yarn comprises cotton fibers. In certain further embodiments, the cotton fibers are Pima, SUPIMA®, or Egyptian cotton fibers.

In certain embodiments, a fabric comprises a first yarn and a second yarn, and the fabric comprises from 25% to 50% of the first yarn, and from 50% to 75% of the second yarn. In certain further embodiments, the fabric comprises at least 35% of the first yarn, and the first yarn comprises COOLMAX® fibers.

In certain embodiments, the fabric has a weight of from 200 grams per square meter (GSM) to 240 GSM. In certain other embodiments, the fabric has a weight of from 90 GSM to 160 GSM.

The present invention is directed, in certain embodiments, to T-shirts comprising a first yarn and a second yarn, wherein the first yarn and second yarn are knit together in an interlock jersey knit. In certain further embodiments, the interior layer of the T-shirt comprises the first yarn, and the exterior layer of the T-shirt comprises the second yarn.

The present invention is directed, in certain embodiments, to dresses comprising a first yarn and a second yarn, wherein the first yarn and second yarn are knit together in an interlock jersey knit. In certain further embodiments, the interior layer of the dress comprises the first yarn, and the exterior layer of the dress comprises the second yarn.

The present invention is directed, in certain embodiments, to methods of manufacturing a fabric, comprising knitting a first yarn with a second yarn in an interlock jersey knit to create the fabric. In certain further embodiments, the knitting is performed by a high-speed interlock machine.

In certain further embodiments, the methods further comprise applying an anti-pilling finish to the fabric. In certain further embodiments, applying the anti-pilling finish to the fabric comprises treating the fabric with an anti-pilling agent. In certain further embodiments, the anti-pilling agent is magnesium chloride.

DETAILED DESCRIPTION OF THE INVENTION

Embodiments of the present invention are directed to fabrics comprising at least two types of yarn, in which the first type of yarn is knit together with the second type of yarn in an interlock jersey knit. An interlock jersey knit is a specific type of knit featuring two rows of stitches, one directly behind the other, where the wales on each side of the fabric are exactly opposite to each other and locked together. The interlock knit creates the impression that the fabric is composed of two layers and is relatively thicker, more stable, and more durable than a conventional jersey knit.

Fabric made from a conventional jersey knit will have a first side that is relatively smooth, and a second side with a more textured appearance and feel (as that second side is composed entirely of purl stiches)—in contrast, both sides of a fabric made from an interlock jersey knit will have a relatively smooth appearance and feel. The edges of fabric made from a conventional jersey knit have a tendency to curl—in contrast, fabric made from the interlock jersey knit will not curl at the edges (that is, it lies flat), nor will it stretch out of shape as easily as would a fabric made from a conventional jersey knit. Fabric made from the interlock jersey knit is relatively better at retaining its shape as compared with a fabric made from a conventional jersey knit.

The present invention encompasses garments comprising the interlock jersey knit fabric, such as shirts, blouses, skirts, dresses, pants, leggings, cardigans, layering vests, suits, jackets, and coats. The present invention also encompasses other articles comprising the interlock jersey knit fabric, such as blankets, scarves, hats, pillows, throw cushions, potholders, and hot pads.

Figure 1:
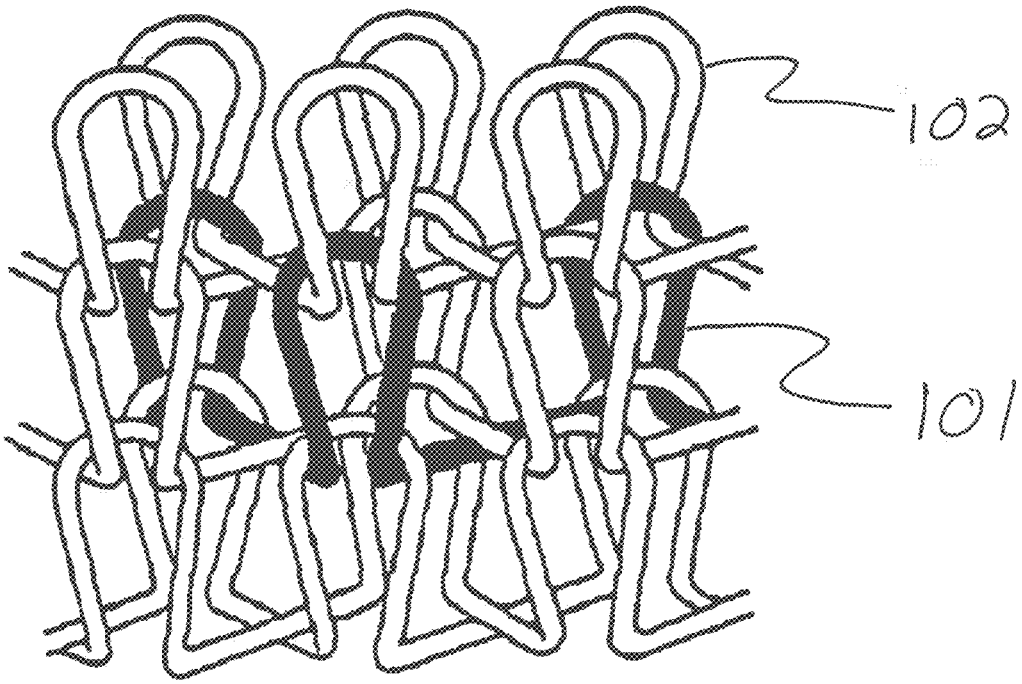
FIG. 1 depicts an interlock jersey knit of a first yarn and a second yarn.

FIG. 1 illustrates an exemplary depiction of an interlock jersey knit, in which loops of a first type of yarn 101 interlock with a second type of yarn 102. Not all stitches are pulled through on all loops, creating one side of the fabric that is composed of the first type of yarn, and a second side of the fabric that is composed of the second type of yarn.

Figure 2:
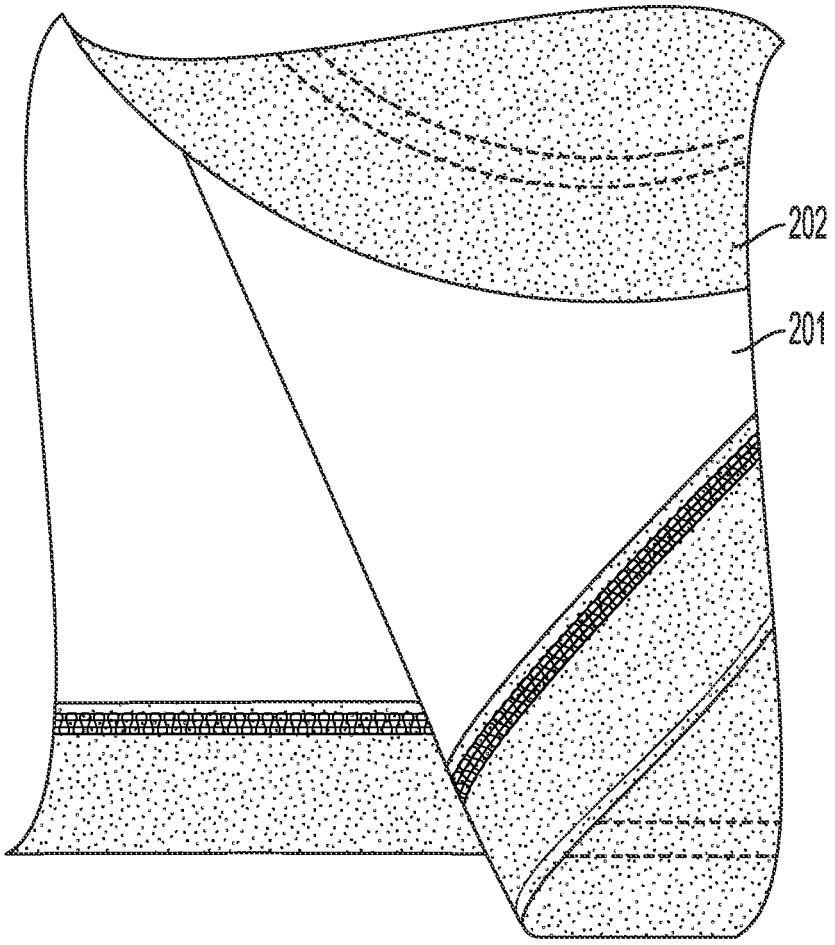
FIG. 2 depicts a fabric composed of a first yarn and a second yarn.

FIG. 2 illustrates an exemplary embodiment of fabric in which a first type of yarn 201 is knit together in an interlock jersey knit with a second type of yarn 202. In the exemplary fabric depicted in FIG. 2 (known as CoolRose™, a trademark of See Rose Go, LLC), the first type of yarn 201 is a technical polyester yarn known as COOLMAX® (a trademark of Invista), and the second type of yarn 202 is a cotton yarn.

The COOLMAX® technical polyester yarn 201 has a number of performance benefits, including: (a) high consistency of fabric performance over time; (b) easy-care; (c) good moisture management and wicking performance; (d) good air permeability; (e) good fabric stability; (f) permanent moisture management performance; and (g) excellent wash fast and colorfast performance. The cotton yarn 202 also has a number of comfort and durability benefits, including: (a) easy-care; (b) soft, comfortable touch; (c) a natural lifestyle look; (d) good fabric stability; (e) a 4-way stretch; and (f) relatively heavier fabric weight. The CoolRose™ fabric depicted in FIG. 2 features the benefits of both yarns 201 and 202, and is (for example) cooling, breathable, no-pilling, comfortable, and easy-care with a 4-way stretch.

In some embodiments, the exemplary CoolRose™ fabric depicted in FIG. 2 can be used to construct garments such as T-shirts (or other types of shirts) or dresses. In these embodiments, the interior side of the garment is composed of the COOLMAX® technical polyester yarn and serves to wick moisture away from the body and allow air permeability, cooling a wearer of the garment. The exterior side of the garment is composed of the cotton yarn, which provides a soft, comfortable, and natural touch and feel from the outside, as well as a natural appearance.

In various embodiments of the invention, nylon, rayon, spandex/elastane, polyester (including technical polyester such as COOLMAX®), cotton, and/or linen yarns may be used to create the fabric. In certain embodiments, the cotton yarn may comprise Pima, SUPIMA®, or Egyptian cotton fibers, or (in some embodiments) a blend of two or more types of cotton fibers.

In some embodiments, the fabric may comprise three or more different types of yarn. For example, in one embodiment, the fabric may comprise rayon, technical polyester, and elastane/spandex yarns. In another embodiment, the fabric may comprise technical polyester yarn and linen yarn.

In various embodiments of the present invention, the properties of the fabric can be altered and customized by using different types of yarn, and different proportions of those types of yarn. For example, if a relatively higher proportion of cotton yarn is used, the fabric would have a relatively heavier drape and more of a cotton feel. In some embodiments, linen yarn could be used to give the fabric a lighter feel, for example to be used in warm-weather garments. In other embodiments, a relatively higher proportion of technical polyester yarn could be used, making the fabric more permeable to air/breathable (in comparison to technical polyester yarn, cotton yarn holds more moisture and expands longer, making its breathability relatively lower).

In some embodiments, the fabric comprises from 25% to 50% technical polyester yarn and from 50% to 75% cotton yarn. In certain of these embodiments, the fabric comprises from 35% to 50% technical polyester yarn and from 50% to 65% cotton yarn. In one specific embodiment, the CoolRose™ fabric comprises 45% COOLMAX® technical polyester yarn, and 55% cotton yarn.

In certain embodiments, the fabric comprises from 50% to 60% rayon yarn, 35% to 45% technical polyester yarn, and 5% elastane/spandex yarn. In certain other embodiments, the fabric comprises from 35% to 40% technical polyester yarn and from 60% to 65% linen yarn.

In various embodiments of the present invention, the weight of the fabric can be varied and customized by using different types of yarn, varying the density of the weave/knit of the fabric, and varying the thickness of the yarn(s) used to create the fabric. For example, in some embodiments, increasing the thickness of the yarn will correspondingly increase the weight of that yarn, and therefore increase the weight of a fabric made from that yarn. Similarly, in some embodiments, increasing the density of the knit of a material in the fabric will result in a fabric with relatively higher weight than a fabric composed of the same material knitted at a lower density knit. And using relatively heavier types of yarn in some embodiments will result in a fabric with a relatively higher weight as compared to fabrics composed of relatively lower-weight yarns.

In some embodiments, the weight of the fabric can be affected by a finish applied to the fabric.

In certain embodiments, the fabric has a weight of from 75 grams per square meter (GSM) to 400 GSM. In certain embodiments, the fabric is a relatively very light weight fabric with a weight of from 75 GSM to 135 GSM. In certain other embodiments, the fabric is a relatively light weight fabric with a weight of from 135 GSM to 200 GSM. In certain other embodiments, the fabric is a relatively medium weight fabric with a weight of from 200 GSM to 270 GSM. In certain other embodiments, the fabric is a relatively medium-heavy weight fabric with a weight of from 270 GSM to 340 GSM. In certain other embodiments, the fabric is a relatively heavy weight fabric with a weight of from 340 GSM to 400 GSM.

In certain embodiments, the fabric has a weight of from 200 GSM to 240 GSM. In certain of these embodiments, the fabric has a weight of from 220 to 225 GSM. In certain other embodiments, the fabric has a weight of from 90 GSM to 160 GSM.

In some embodiments, the interlock jersey knit is knitted by a human knitter using two yarns and at least two knitting needles to create (for example) items such as scarves or hats. In other embodiments, the interlock jersey knit fabric is knit at a factory or mill using one or more high-speed interlock knitting machines, using multiple needles and computer programming. In these embodiments, the machine(s) use finer yarn to create fabric suitable for relatively larger scale production of garments such as shirts, blouses, skirts, dresses, pants, suits, and/or jackets.

Figure 3:
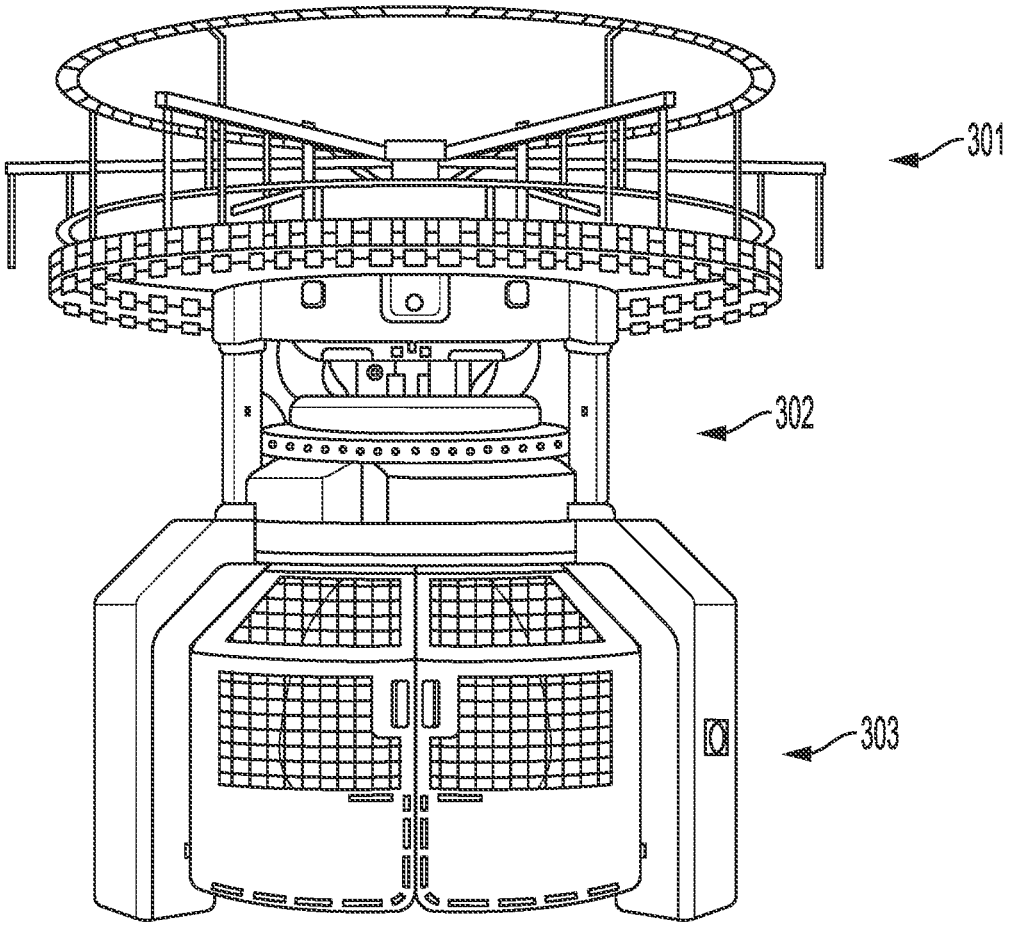
FIG. 3 depicts a high-speed interlock machine.

FIG. 3 depicts an exemplary embodiment of such a high-speed interlock knitting machine. The yarn to be knitted by the machine is depicted at 301, with the needles depicted at 302 and the location at which the fabric is output by the machine depicted at 303.

In some embodiments, an anti-pilling finish is added to the fabric before the fabric is used to construct garments or other items. Anti-pilling finish can also be applied to constructed garments or other items. "Pills" refer to masses of tangled fibers that appear on fabric surfaces during wear or laundering. Loose fibers are pulled from yarn(s) in the fabric and are formed into spherical balls by the frictional forces of abrasion. The pills of tangled fibers are held to the fabric surface by longer fibers known as "anchor fibers."

In these embodiments, the anti-pilling finish reduces the formation of pills on the fabric. In some embodiments, the anti-pilling finish is a chemical treatment applied to the fabric. This chemical treatment suppresses the ability of fibers to break from the yarn(s) in the fabric, preventing those fibers from tangling with each other and forming pills. In some embodiments, the chemical treatment is padded onto the surface of the fabric, then heat set to apply the anti-pilling finish to the fabric.

The examples described above and depicted in FIGS. 1-3 are only illustrative, and it will be readily understood by one of ordinary skill in the art that the present invention fulfills all of the objectives set forth above. After reading the foregoing specification, one of ordinary skill in the art will be able to effect various changes, substitutions of equivalents, and various other embodiments of the invention as broadly discussed therein.

What is claimed is:

1. A fabric comprising:

(a) a first yarn, wherein the first yarn consists of one or more of nylon fibers, rayon fibers, spandex/elastane fibers, and polyester fibers; and (b) a second yarn, wherein the second yarn consists of one or more of cotton fibers and linen fibers, and wherein the first yarn and the second yarn are knit together in an interlock jersey knit, and wherein the fabric comprises from 35% to 40% of the first yarn and from 60% to 65% of the second yarn.

2. The fabric according to claim 1, wherein the first yarn consists of polyester fibers.

3. The fabric according to claim 2, wherein the polyester fibers are technical polyester fibers.

4. The fabric according to claim 2, wherein the second yarn consists of linen fibers.

5. The fabric according to claim 2, wherein the second yarn consists of cotton fibers.

6. The fabric according to claim 3, wherein the second yarn consists of linen fibers.

7. The fabric according to claim 3, wherein the second yarn consists of cotton fibers.

8. The fabric according to claim 1, wherein the fabric further comprises a third yarn.

9. The fabric according to claim 8, wherein the third yarn comprises spandex/elastane fibers.

10. The fabric according to claim 8, wherein the first yarn consists of rayon fibers, the second yarn consists of linen fibers, and the third yarn comprises spandex/elastane fibers.

11. The fabric according to claim 8, wherein the fabric comprises 35% of the first yarn, 60% of the second yarn, and 5% of the third yarn.

12. The fabric according to claim 9, wherein the fabric comprises 35% of the first yarn, 60% of the second yarn, and 5% of the third yarn.

13. The fabric according to claim 1, wherein the second yarn consists of cotton fibers.

14. The fabric according to claim 13, wherein the cotton fibers comprise one or more of Pima cotton fibers and Egyptian cotton fibers.

15. The fabric according to claim 1, wherein the fabric has a weight of from 200 GSM to 240 GSM.

16. The fabric according to claim 1, wherein the fabric has a weight of from 90 GSM to 160 GSM.

17. The fabric according to claim 1, wherein the fabric has a weight of from 135 GSM to 200 GSM.

18. The fabric according to claim 1, wherein the fabric has a weight of from 340 GSM to 400 GSM.

19. A T-shirt comprising the fabric according to claim 1, wherein the interior layer of the T-shirt comprises the first yarn, and the exterior layer of the T-shirt comprises the second yarn.

20. A dress comprising the fabric according to claim 1, wherein the interior layer of the dress comprises the first yarn, and the exterior layer of the dress comprises the second yarn.

21. A fabric comprising a first yarn and a second yarn, wherein the first yarn consists of one or more of nylon fibers, rayon fibers, spandex/elastane fibers, and polyester fibers, wherein the second yarn consists of one or more of cotton fibers and linen fibers, wherein the first yarn and the second yarn are knit together in an interlock jersey knit, and wherein the fabric is composed of from 25% to 50% of the first yarn and from 50% to 75% of the second yarn.

22. The fabric according to claim 21, wherein the fabric is composed of 45% of the first yarn and 55% of the second yarn.

23. The fabric according to claim 22, wherein the first yarn consists of polyester fibers and the second yarn consists of cotton fibers.

24. The fabric according to claim 23, wherein the polyester fibers are technical polyester fibers.

25. The fabric according to claim 21, wherein the fabric is composed of at least 35% of the first yarn, and wherein the first yarn is made of polyester fibers.

26. The fabric according to claim 25, wherein the polyester fibers are technical polyester fibers.

27. The fabric according to claim 25, wherein the second yarn consists of cotton fibers.

28. The fabric according to claim 25, wherein the second yarn consists of linen fibers.

29. The fabric according to claim 26, wherein the second yarn consists of cotton fibers.

30. The fabric according to claim 26, wherein the second yarn consists of linen fibers.

31. A fabric consisting of a first yarn and a second yarn, wherein the first yarn comprises one or more of nylon fibers, rayon fibers, spandex/elastane fibers, and polyester fibers, wherein the second yarn comprises one or more of cotton fibers and linen fibers, wherein the first yarn and the second yarn are knit together in an interlock jersey knit, and wherein the fabric is composed of from 35% to 45% of the first yarn and from 55% to 65% of the second yarn.

32. The fabric according to claim 31, wherein the first yarn comprises polyester fibers and the second yarn comprises cotton fibers.

33. The fabric according to claim 31, and an anti-pilling agent that has been applied to the fabric.

* * * * *